US005215844A

United States Patent [19]

Badesha et al.

[11] Patent Number: 5,215,844

[45] Date of Patent: Jun. 1, 1993

[54] PHOTOCONDUCTIVE IMAGING MEMBERS WITH POLYHYDROXY ETHER BINDERS

[75] Inventors: Santokh S. Badesha, Pittsford; Damodar M. Pai, Fairport, both of N.Y.

[73] Assignee: Xerox Corporation, Stamford, Conn.

[21] Appl. No.: 754,090

[22] Filed: Sep. 3, 1991

[51] Int. Cl.[5] ..... G03G 5/05; G03G 5/047

[52] U.S. Cl. ..... 430/96; 430/58; 430/59; 430/66

[58] Field of Search ..... 430/96, 59, 66, 58

[56] References Cited

U.S. PATENT DOCUMENTS

| | | | |
|---|---|---|---|
| 4,265,990 | 5/1991 | Stolka et al. | 430/59 |
| 4,439,507 | 3/1984 | Pan et al. | 430/59 |
| 4,490,452 | 12/1984 | Champ et al. | 430/58 |
| 4,618,551 | 10/1986 | Stolka et al. | 430/58 |
| 4,725,518 | 2/1988 | Carmichael et al. | 430/58 |
| 5,034,295 | 7/1991 | Allen et al. | 430/58 |

*Primary Examiner*—Marion E. McCamish
*Assistant Examiner*—Rosemary Ashton
*Attorney, Agent, or Firm*—E. O. Palazzo

[57] ABSTRACT

A photoconductive imaging member comprised of a photogenerating layer comprised of a photogenerating pigment or pigments dispersed in a linear phenoxy resin with a weight average molecular weight of from about 50,000 to about 150,000, and a transport layer comprised of transport molecules dispersed in a resinous binder.

22 Claims, 2 Drawing Sheets

PHOTOCONDUCTIVE IMAGING MEMBERS WITH POLYHYDROXY ETHER BINDERS

BACKGROUND OF THE INVENTION

This invention is generally directed to photoconductive imaging members, and more specifically to imaging members with polyhydroxy ether resin binders. The present invention in one embodiment is directed to layered imaging members comprised of charge generating layers with charge photogenerating pigments dispersed in certain polyhydroxy ether resin binders. In a specific embodiment, the present invention relates to layered imaging members comprised of a photogenerating layer comprised of photogenerating pigments dispersed in a linear phenoxy resin binder and a charge, especially hole transport layer wherein the transport molecules thereof can be dispersed in a resinous binder. Further, in another embodiment of the present invention the imaging member is comprised of a supporting substrate, a photogenerating layer comprised of photogenerating pigments dispersed in a linear high molecular weight of from between about 50,000 to about 150,000 phenoxy resin binder, wherein the binder is present in an effective amount such as from between about 10 to about 60, and between about 15 to about 40 weight percent, and in contact therewith a charge, especially a hole transport layer comprised of hole transport molecules dispersed in a resinous binder. The charge transport layer can be located as the top layer of the imaging member or alternatively it may be situated between a supporting substrate and the photogenerating layer. Imaging members with the aforementioned poly(-hydroxyether) binders can possess a number of advantages including, for example, excellent dispersion of the photogenerating pigment therein; achievement of uniform layers; excellent dispersion stability; acceptable coatability characteristics; higher loadings of photogenerating pigment because of the linear nature of the material selected; superior adhesion characteristics of the photogenerating layer to other layers; compatibility with charge transport molecules; superior solubility of the polymer; ease of dispersion formation; and the linear polymer is in many instances very pure.

The imaging members of the present invention can be selected for a number of known imaging, especially xerographic, and printing processes including electrophotographic imaging and printing processes.

The formation and development of electrostatic latent images on the imaging surfaces of photoconductive materials by electrostatic means is well known. Numerous different photoconductive members for use in xerography are known such as selenium, alloys of selenium, layered imaging members comprised of aryl amine charge transport layers, reference U.S. Pat. No. 4,265,990, and imaging members with charge transport layers comprised of polysilylenes, reference U.S. Pat. No. 4,618,551. The disclosures of the aforementioned patents are totally incorporated herein by reference. With the aforementioned imaging members, especially those of the '990 patent, there are selected aryl amine charge transport layers, which aryl amines are soluble in halogenated hydrocarbons such as methylene chloride. The resin binders of the present invention can also be selected as resinous binders for photogenerating layers of imaging members with electron transport layers, reference U.S. Pat. No. 4,474,865, the disclosure of which is totally incorporated herein by reference.

There is illustrated in U.S. Pat. No. 4,439,507, the disclosure of which is totally incorporated herein by reference, layered imaging members with photogenerating pigments dispersed in a poly(hydroxyether), reference for example the Abstract, the Figures, and columns 3 to 6. The layered imaging members of the present invention can be comprised of many of the same components of the aforementioned patent with the primary exception that there is selected as the resin binder for the members of the present invention linear, high molecular weight, poly(hydroxyethers) thereby enabling the advantages of the present invention, and more specifically superior dispersion of the photogenerating pigment as compared to the resin binders of the '507 patent.

In U.S. Pat. Nos. 4,869,988 and 4,946,754, the disclosures of which are totally incorporated herein by reference, there are described layered photoconductive imaging members with transport layers incorporating, for example, biaryl diarylamines, N,N-bis(biaryl)anilines, and tris(biarylyl)amines as charge transport compounds dispersed in a number of known resin binders. In the abovementioned patents, there are disclosed improved layered photoconductive imaging members comprised of a supporting substrate, a photogenerating layer optionally dispersed in an inactive resinous binder, and in contact therewith a charge transport layer comprised of the above-mentioned charge transport compounds, or mixtures thereof dispersed in resinous binders.

Examples of specific hole transporting components disclosed in U.S. Pat. No. 4,869,988 include N,N-bis(4-biphenylyl)-3,5-dimethoxyaniline (Ia); N,N-bis(4-biphenylyl)-3,5-dimethylaniline (Ib); N,N-bis(4-methyl-4'-biphenylyl)-3-methoxyaniline (Ic); N,N-bis(4-methyl-4'-biphenylyl)-3-chloroaniline (Id); N,N-bis(4-methyl-4'-biphenylyl)-4-ethylaniline (Ie); N,N-bis(4-chloro-4'-biphenylyl)-3-methylaniline (If); N,N-bis(4-bromo-4'-biphenylyl)-3,5-dimethoxy aniline (Ig); 4-biphenylyl bis(4-ethoxycarbonyl-4'-biphenylyl)amine (IIa); 4-biphenylyl bis(4-acetoxymethyl-4'-biphenylyl)amine (IIb); 3-biphenylyl bis(4-methyl-4'-biphenylyl)amine (IIc); 4-ethoxycarbonyl-4'-biphenylyl bis(4-methyl-4'-biphenylyl)amine (IId); and the like.

Examples of specific hole transporting compounds disclosed in U.S. Pat. No. 4,946,754 include bis(p-tolyl)-4-biphenylylamine (IIa); bis(p-chlorophenyl)-4-biphenylylamine (IIb); N-phenyl-N-(4-biphenylyl)-p-toluidine (IIc); N-(4-biphenylyl)-N-(p-chlorophenyl)-p-toluidine (IId); N-phenyl-N-(4-biphenylyl)-p-anisidine (IIe); bis(m-anisyl)-4-biphenylylamine (IIa); bis(m-tolyl)-4-biphenylylamine (IIIb); bis(m-chlorophenyl)-4-biphenylylamine (IIIc); N-phenyl-N-(4-biphenylyl)-m-toluidine (IIId); N-phenyl-N-(4-bromo-4'-biphenylyl)-m-toluidine (IVa); diphenyl-4-methyl-4'-biphenylylamine (IVb); N-phenyl-N-(4-ethoxycarbonyl-4'-biphenylyl)-m-toluidine (IVb); N-phenyl-N-(4-methoxy-4'-bipehnylyl)-m-toluidine (IVd); N-(m-anisyl)-N-(4-biphenylyl)p-toluidine (IVe); bis(m-anisyl)-3-biphenylylamine (Va); N-phenyl-N-(4-methyl-3'-biphenylyl)-p-toluidine (Vb); N-phenyl-N-(4-methyl-3'-biphenylyl)-m-anisidine (Vc); bis(m-anisyl)-3-biphenylylamin (Vd); bis(p-tolyl)-4methyl-3'-biphenylylamine (Ve); N-p-tolyl-N-(4methoxy-3'-biphenylyl)-m-chloroaniline (Vf), and the like. The aforementioned charge, especially hole transport components, can be selected for the imaging members of the present invention in embodiments thereof.

It is also indicated in the aforementioned patents that there may be selected as resin binders for the charge transport molecules those components as illustrated in U.S. Pat. No. 3,121,006 including polycarbonates, polyesters, epoxy resins, polyvinylcarbazole; and also wherein for the preparation of the charge transport layer with a polycarbonate there is selected methylene chloride as a solvent.

There is also mentioned as prior art U.S. Pat. No. 4,657,993, the disclosure of which is totally incorporated herein by reference, directed to polyphosphazene homopolymers and copolymers of the formula as recited, for example, in the Abstract of the Disclosure, which components may be selected as photoconductive materials and for other uses, see column 1, and continuing on to column 2; and as background interest directed to processes for the preparation of phosphonitrilic polymer mixtures, reference the Abstract of the Disclosure, U.S. Pat. No. 3,515,688 related to phosphonitrile elastomers, reference for example the Abstract of the Disclosure; U.S. Pat. No. 3,702,833 directed to curable fluorophosphazene polymers, see for example column 1; and U.S. Pat. No,. 3,858,712 directed to polyp polyphosphazene copolymers which are elastomers. The disclosures of each of the aforementioned patents are totally incorporated herein by reference.

SUMMARY OF THE INVENTION

It is therefore a feature of the present invention to provide layered photoresponsive imaging members with many of the advantages indicated herein.

Also, it is a feature of the present invention to provide binders for photogenerating pigments contained in layered photoconductive imaging members.

It is yet another feature of the present invention to provide layered photoresponsive imaging members with charge, especially hole transport layers in contact with a photogenerating layer, which members are suitable for use with liquid and dry developers.

In a further feature of the present invention there is provided a layered photoresponsive imaging member with a photogenerating layer situated between a supporting substrate, and a hole transport layer with a polycarbonate resin binder.

In yet another feature of the present invention there is provided a photoresponsive imaging member comprised of a hole transporting layer situated between a supporting substrate and a photogenerating layer comprised of a photogenerating pigments dispered in a linear phenoxy resin binder thereby enabling, for example, superior dispersion of such pigments, and many of the other advantages illustrated herein.

In another feature of the present invention there are provided imaging and printing methods with the layered imaging members disclosed herein.

Also, in another feature of the present invention there are provided imaging members with charge transport layers that are free or substantially free of charge trapping.

Another feature of the present invention resides in the provision of imaging members with electrical stability for an extended number of imaging cycles, for example exceeding 200,000 in some instances.

These and other features of the present invention can be accomplished in embodiments thereof by the provision of layered imaging members comprised, for example, of a photogenerating layer and a charge transport layer. More specifically, the present invention is directed to layered photoconductive imaging members comprised of photogenerating layers, and in contact therewith charge transport layers comprised of, for example charge, especially hole transporting aryl amines, the amines of U.S. Pat. No. 4,299,897, the disclosure of which is totally incorporated herein by reference, and the like dispersed, for example, in known resin binders, such as MAKROLON ® polycarbonates and the like, and wherein the photogenerating pigments are dispersed in a phenoxy resin binder.

In one embodiment, the present invention is directed to a layered photoconductive imaging member comprised of a supporting substrate, a photogenerating layer comprised of organic or inorganic photoconductive pigments dispersed in a linear high molecular weight phenoxy resinous binder, and in contact therewith a hole transport layer comprised of the aryl amines as illustrated in U.S. Pat. No. 4,265,990, the disclosure of which is totally incorporated herein by reference, and the aforementioned '897 patent. The aforementioned linear phenoxy in embodiments of the present invention possesses a weight average molecular weight of from about 50,000 to about 150,000, and preferably 80,000 to about 150,000, including specifically 100,000 as determined by a Waters Gel Permeation Chromatograph employing four Ultrastyragel ® columns with pore sizes of 100, 500, and 5,000 Angstroms and using THF (tetrahydrofuran) as a solvent. The poly(hydroxyethers) of the present invention can be obtained, for example, by the reaction of bisphenol A with an epichlorohydrin.

Examples of specific charge transporting molecules in addition to the aryl amines disclosed herein include molecules of the following formula wherein X is independently selected from halogen or alkyl, and preferably N,N'-diphenyl-N,N'-bis(3-methyl phenyl)-(1,1'-biphenyl)-4,4'-diamine.

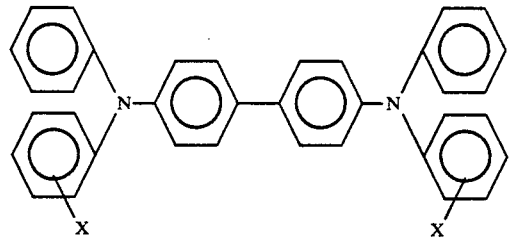

The photoresponsive imaging members of the present invention can be prepared by a number of known methods, the process parameters and the order of the coating of the layers being dependent on the member desired. Thus, for example, the photoresponsive members of the present invention can be prepared by providing a conductive substrate with an optional charge blocking layer and an optional adhesive layer, and applying thereto a photogenerating layer dispered in a linear phenoxy resin, and overcoating thereon a charge transport layer dispersed in a resinous binder. The photoresponsive imaging members of the present invention can be fabricated by common known coating techniques such as by dip coating, draw-bar coating, or by spray coating process, depending mainly on the type of imaging devices desired. Each coating, however, can be usually dried, for example, in a convection or forced air oven at a suitable temperature before a subsequent layer is applied thereto. In one embodiment of the present invention, the transport layer can be fabricated from a 10 weight percent solution of the charge transporting molecules, which molecules are usually present in an amount of from about 35 to about 60 weight percent, and preferably 40 weight percent, and are dispersed in a polycarbonate resinous binder, and preferably in an amount of 60 weight percent. The aforementioned solution can be obtained by stirring 6 grams of the selected polycarbonate, such as MAKROLON ®, and the like, and 4 grams of the charge transport molecule in 100 milliliters of methylene chloride at ambient temperature, about 25° C. for example. The resulting solution can then be draw bar coated on the photogenerating layer and thereafter dried. The drying temperature is dependent on a number of factors including the components selected, particularly the photogenerating component, but generally drying is accomplished at about 130° C., especially in situations wherein trigonal selenium is selected as the photogenerating pigment dispersed in a linear poly(hydroxyether) binder.

In an illustrative embodiment, the photoconductive imaging member of the present invention is comprised of (1) a conductive supporting substrate of MYLAR ® with a thickness of 75 microns and a conductive vacuum deposited layer of titanium with a thickness of 0.02 micron; (2) a hole blocking layer of N-methyl-3-aminopropyltrimethoxy silane with a thickness of 0.1 micron; (3) an adhesive layer of 49,000 Polyester (obtained from E.I. DuPont Chemical) with a thickness of 0.05 micron; (4) a photogeneration layer of trigonal selenium dispersed in a linear phenoxy resin, which layer can have a thickness of 1 micron; and (5) a charge transport layer with a thickness of 20 microns of an aryl amine dipersed in a resin binder of a block copolycarbonate of bisphenol and polydiphenyl siloxane.

BRIEF DESCRIPTION OF THE INVENTION

DETAILED DESCRIPTION OF THE INVENTION

Figure 1:
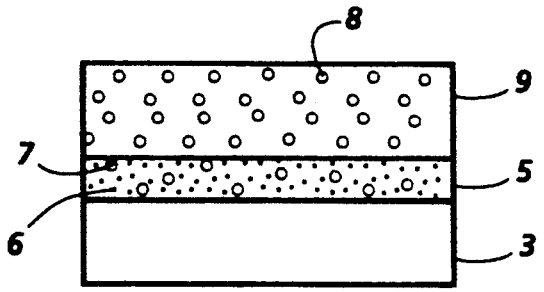
FIG. 1 represents a partially schematic cross-sectional view of a photoresponsive imaging member of the present invention.

Illustrated in FIG. 1 is a photoresponsive imaging member of the present invention comprising a supporting substrate 3 of a thickness of from about 50 microns to about 5,000 microns, a charge carrier photogenerating layer 5 of a thickness of from about 0.5 micron to about 5 microns comprised of a photogenerating pigment or pigments 6 dispersed in a linear phenoxy 7, such as the phenoxy obtained by the reaction of a bisphenol A wherein the R substituents on the carbon linking the aromatic hydroxy rings can be alkyl with, for example, from 1 to about 10 carbon atoms, such as methyl, ethyl, propyl, butyl, and the like, which phenoxy has a weight average molecular weight of about 150,000 and a charge transport layer 9 of a thickness of from about 10 microns to about 60 microns comprised of an aryl amine dispersed in an inactive resin binder 8.

Figure 2:
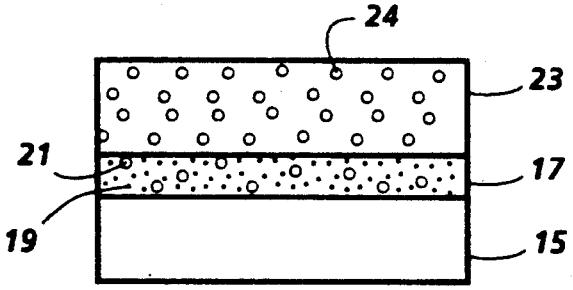
FIGS. 2 and 3 represent partially schematic cross-sectional views of photoresponsive imaging members of the present invention.

Illustrated in FIG. 2 is a photoresponsive imaging member of the present invention comprised of about a 25 micron to about a 100 micron thick conductive supporting substrate 15 of aluminized MYLAR ®, a 0.5 micron to about a 5 micron thick photogenerating layer 17 comprised of trigonal selenium photogenerating pigments 19 dispersed in a linear phenoxy 21, such as 4,4'-(1-methylethyldene)bisphenol-poly(hydroxyether) with a molecular weight of 150,000 in an amount of 10 percent to about 80 percent by weight, and a 10 micron to about a 60 micron thick hole transport layer 23 comprised of the aryl amine charge transport N,N'-diphenyl-N,N'-bis(3-methylphenyl)1,1'-biphenyl-4,4'-diamine dispersed in the polycarbonate resin binder 24, MAKROLON ®.

Figure 3:
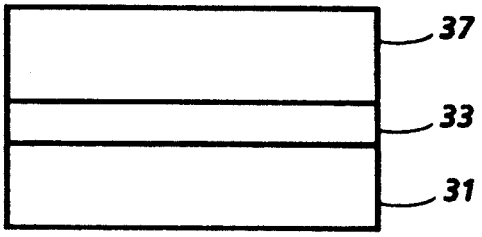

Another photoresponsive imaging member of the present invention, reference FIG. 3, is comprised of a conductive supporting substrate 31 of aluminum of a thickness of 50 microns to about 5,000 microns, a photogenerating layer 33 comprised of 35 weight percent of vanadyl phthalocyanine pigment particles of a thickness of 0.1 micron to about 5 microns dispersed in the linear phenoxy resin of FIG. 2, and a 10 micron to about 60 micron thick hole transport layer 37 comprised of the aryl amine hole transport N,N'-diphenyl-N,N'-bis(3-methylphenyl)1,1'-biphenyl-4,4'-diamine, 55 weight percent, dispersed in a MAKROLON ® polycarbonate resin binder.

Figure 4:
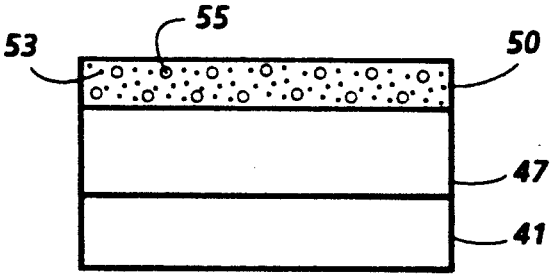
FIG. 4 represents a partially schematic cross-sectional view of a photoresponsive imaging member of the present invention wherein the hole transporting layer is situated between a supporting substrate and the photogenerating layer.

Illustrated in FIG. 4 is another photoresponsive imaging member of the present invention comprised of a 25 micron to 100 micron thick conductive supporting substrate 41 of aluminized MYLAR ®, a 10 micron to about 60 micron thick hole transport layer 47 comprised of N,N'-diphenyl-N,N'-bis(3-methylphenyl)1,1'-biphenyl-4,4'-diamine hole transport molecules, 40 weight percent, dispersed in the polycarbonate of FIG. 3, resin binder and a 0.1 micron to about 5 micron thick photogenerating layer 50 comprised of x-metal free phthalocyanine, vanadyl phthalocyanine, titanyl phthalocyanine, especially Type IV, photogenerating pigments 53 dispersed in the phenoxy, of FIG. 1, resinous binder 55 in an amount of about 10 percent to about 80 percent by weight.

The supporting substrate layers may be opaque or substantially transparent and may comprise any suitable material possessing, for example, the requisite mechanical properties. The substrate, many of which are known, may comprise a layer of an organic or inorganic material having a conductive surface layer arranged thereon or a conductive material such as, for example, aluminum, chromium, nickel, indium, tin oxide, brass or the like. The substrate may be flexible, seamless, or rigid and can be comprised of various different configurations such as, for example, a plate, a cylindrical drum, a scroll, and the like. The thickness of the substrate layer is dependent on many factors including, for example, the components of the other layers, and the like; generally, however, the substrate is generally of a thickness of from about 50 microns to about 5,000 microns.

Examples of photogenerating layers, especially since they permit imaging members with a photoresponse of from about 400 to about 700 nanometers, for example, include those comprised of known photoconductive charge carrier generating materials, such as trigonal selenium, cadmium sulfide, cadmium selenide and cadmium sulfoselenide, and the like, reference U.S. Pat.

Nos. 4,232,102 and 4,233,283, the disclosures of each of these patents being totally incorporated herein by reference. The thickness of the photogenerating layer is dependent on a number of factors, such as the materials included in the other layers, and the like; generally, however, this layer is of a thickness of from about 0.1 micron to about 5 microns, and preferably from about 0.2 micron to about 2 microns, depending on the photoconductive volume loading, which may vary from about 5 percent to about 100 percent by weight. Generally, it is desirable to provide this layer in a thickness which is sufficient to absorb about 90 percent or more of the incident radiation which is directed upon it in the imagewise exposure step. The maximum thickness of this layer is dependent primarily upon factors such as mechanical considerations, for example, whether a flexible photoresponsive device is desired. Also, there may be selected as photogenerators organic components such as squaraines, perylenes, reference for example U.S. Pat. No. 4,587,189, the disclosure of which is totally incorporated herein by reference, metal phthalocyanines, metal free phthalocyanines, vanadyl phthalocyanine, titanyl phthalocyanines, such as Type IV, dibromoanthanthrone, and the like. The aforementioned photogenerating pigments are dispersed in the linear phenoxy resin binders as illustrated herein.

The charge transport layer can be comprised of one or a mixture of hole transporting molecules in the amount of from about 10 percent to about 60 percent by weight thereof in some embodiments of the transport molecules illustrated herein, and preferably the aryl amines of the formula illustrated herein. The thickness of the transport layer is, for example, from about 5 microns to about 50 microns with the thickness depending predominantly on the nature of intended applications. In addition, a layer of adhesive material located, for example, between the photogenerating layer and the substrate layer to promote adhesion thereof can be utilized. This layer may be comprised of known adhesive materials such as polyester resins, reference 49,000 polyester available from E.I. DuPont Chemical Company, polysiloxane, acrylic polymers, and the like. A thickness of from about 0.001 micron to about 0.1 micron is generally employed for the adhesive layer. Hole blocking layers usually situated between the substrate and the photogenerating layer, and preferably in contact with the supporting substrate include, for example, those derived from the polycondensation of aminopropyl trialkoxysilane or aminobutyl trialkoxysilane, such as 3-aminopropyltrimethoxy silane, 3-aminopropyltriethoxy silane, or 4-aminobutyltrimethoxy silane thereby improving in some embodiments the dark decay characteristics of the imaging member. Typically, this layer has a thickness of from about 0.001 micron to about 0.1 micron or more in thickness depending on the desired effectiveness for preventing or minimizing the dark injection of charge carriers into the photogenerating layer.

The imaging members of the present invention can be selected for electrostatographic, especially xerographic, imaging and printing processes wherein, for example, a positively or negatively charged imaging member is selected, and developing the image with toner comprised of resin, such as styrene acrylates, styrene methacrylates, styrene butadienes, and the like, pigment, such as carbon black, and a charge additive such as distearyl dimethyl ammonium methyl sulfate.

The following Examples, except for any comparative Examples, are being supplied to further define specific embodiments of the present invention, it being noted that these examples are intended to illustrate and not limit the scope of the present invention. Also, parts and percentages are by weight unless otherwise indicated. A comparative working Example data is also presented.

EXAMPLE I

Bisphenol A polyhydroxy ether was prepared by adding to a one liter three necked 1,000 milliliter round bottom flask 22.83 grams of the Bisphenol A, 4,4'-(1-methylethyldene), and 39.05 grams of EPON-825®, (1-chloro-2,3-epoxy propane) a commercially available epichlorohydrin. The flask was fitted with a reflux condensor, a stirrer, and a nitrogen inlet. The reactants were then heated to 95° C. under a blanket of nitrogen, and there was added thereto 0.5 gram of triphenylphosphine. Simultaneously, in a separate 1,000 milliliter flask there were added 500 milliliters of 1,4-dioxane, and this material was refluxed with heating under nitrogen for about 15 minutes, after which the contents of the flask became viscous. A small portion, about 20 milliliters, of the hot 1,4-dioxane was added to the first reaction flask. Stirring and heating under nitrogen was continued for 30 minutes. Additional portions, 25 milliliters each of the hot 1,4-dioxane, were then added to the reaction flask over a two hour period. The mixture resulting was further heated at 100° C. for 48 hours, followed by cooling to room temperature, about 25° C., and thereafter pouring slowly the reaction mixture into excess cold water, about 5 liters. The water was vigorously stirred during the addition of the reaction mixture resulting in a gummy polymer, which polymer was separated from the reaction mixture by filtration, redissolved in tetrahydrofuran, 250 milliliters, and thereafter poured slowly into a 1:1 mixture of 1,000 milliliters of methanol:water; this was repeated five times. The polymer obtained was then collected by filtration as a white flaky solid, and was dried at 55° C. under a vacuum at $10^{-2}$ Torr. The product was characterized by NMR, IR, and found to be 4,4'-(1-methylethyldene)bisphenol(-polyhydroxyether) derived from bisphenol and epichlorohydrin. The molecular weight of the product polymer was 150,000 as determined by GPC, gel permeation chromatography using tetrahydrofuran as a solvent. The viscosity in tetrahydrofuran solvent was 0.81. NMR indicated that the polymer product had 0.1 to 0.4 branches per 10 repeat units.

EXAMPLE II

A photoresponsive imaging member was prepared by providing an aluminized MYLAR® substrate in a thickness of 75 microns, followed by applying thereto with a multiple-clearance film applicator a solution of N-methyl-3-aminopropyl-trimethoxy silane (obtained from PCR Research Chemicals) in ethanol (1:20 volume ratio). This hole blocking layer, 0.1 micron, was dried for 5 minutes at room temperature, and then cured for 10 minutes at 110° C. in a forced air oven. There was then applied to the above silane layer a solution of 0.5 percent by weight of 49,000 polyester (obtained from E.I. DuPont Chemical) in a mixture of methylene chloride and 1,1,2-trichloroethane (4:1 volume ratio) with a multiple-clearance film applicator. The layer was allowed to dry for one minute at room temperature, and 10 minutes at 100° C. in a forced air oven. The resulting adhesive layer had a dry thickness of 0.05 micron.

To a 4 ounce amber glass bottle there were added 17.0 milliliters of methylcellosolve acetate, 4.3 grams of powdered trigonal selenium, 1.6 grams of the Bisphenol A poly(hydroxy ether) of Example I, and 200 grams of ⅛ inch diameter, 316 steel shots. The resulting mixture was then rolled on a roller mill for 48 hours resulting in a dispersion of trigonal selenium, particle size diameter 0.03 to 0.15 micron, which dispersion was stable for one month. About 1.5 grams of the dispersion was then added to 2.5 grams of a solution of tetrahydrofuran containing 0.025 gram of N,N'-diphenyl-N,N'-bis(3-methylphenyl)1,1'-biphenyl-4,4'-diamine. The photogenerating layer coating was applied with a 0.005 inch Bird applicator, and the layer was then dried at about 135° C. in a forced air oven to form a photogenerating layer of 2 microns in thickness.

A solution of 4.0 grams of the aryl amine N,N'-diphenyl-N,N'-bis(3-methylphenyl)1,1'-biphenyl-4,4'-diamine and 6 grams of the polycarbonate, MAKROLON ®, resin binder in 100 milliliters of methylene chloride was then coated over the photogenerator layer by means of a multiple-clearance film applicator. The resulting member was subsequently dried in a forced air oven at 130° C. for 30 minutes resulting in a 22 micron thick hole transport layer with 60 weight percent of the polycarbonate resin binder MAKROLON ®.

The above fabricated imaging or photoconductive member comprised of an aluminum substrate, trigonal selenium dispersed in the poly(hyroxyether) as a photogenerator, and in contact therewith the above charge transport layer was electrically tested by negatively charging it with a corona, and discharged by exposing it to white light of wavelengths of from 400 to 700 nanometers. Charging was accomplished with a single wire corotron in which the wire was contained in a grounded aluminum channel and was strung between two insulating blocks. The acceptance potential of this imaging member after charging, and its residual potential after exposure were recorded. The procedure was repeated for different exposure energies supplied by a 75 watt Xenon arc lamp of incident radiation, and the exposure energy required to discharge the surface potential of the member to half of its original value was determined. This surface potential was measured using a wire loop probe contained in a shielded cylinder, and placed directly above the photoreceptor member surface. This loop was capacitively coupled to the photoreceptor surface so that the voltage of the wire loop corresponds to the surface potential. Also, the cylinder enclosing the wire loop was connected to the ground.

The above imaging member was negatively charged to a surface potential of 800 volts, and discharged to a residual potential of 65 volts. The dark decay of this member was about 20 volts/second, and the electrical properties of the imaging member remained essentially unchanged for 10,000 cycles of repeated charging and discharging.

EXAMPLE III

A layered photoresponsive imaging member was fabricated by repeating the procedure of Example II with the exception that there was selected as the trigonal selenium photogenerating resin binder a prior art poly(hydroxy ether), available as BAKELITE ®, which has a molecular weight of 20,000 to about 30,000 and a viscosity of 0.42. This ether polymer was not linear and had 2.0 to 2.5 branches per 10 repeat units, and the dispersion was only stable in that trigonal selenium was observed at the bottom of the flask after one week. The imaging member resulting was charged by corona to a surface potential of 800 volts and discharged to a residual potential of 90 volts. The dark decay of this member was 100 volts/second, or about 80 volts/second more than that of the imaging member of Example II.

Higher dark decay can result in undesirable lower dark development potentials in the layered photoresponsive imaging device.

EXAMPLE IV

An electrophotographic photoconductive imaging member was prepared by forming coatings using conventional coating techniques on a substrate comprising a vacuum deposited titanium layer on a polyethylene terephthalate film (MYLAR ® available from E.I. DuPont de Nemours & Company). The first coating was a siloxane barrier layer formed from hydrolyzed gamma aminopropyl triethoxysilane having a thickness of 50 Angstroms. This film was coated as follows: 3-aminopropyltriethoxysilane (available from PCR Research Chemicals of Florida) was mixed in ethanol in a 1:50 volume ratio. The film was applied to a wet thickness of 0.5 mil by a multiple clearance film applicator. The layer was then allowed to dry for 5 minutes at room temperature, 25° C., followed by curing for 10 minutes at 110° C. in a forced air oven. The second coating was an adhesive layer of polyester resin (49,000 available from E.I. DuPont de Nemours & Company) having a thickness of 50 Angstroms and was coated as follows: 0.5 gram of 49,000 resin was dissolved in 70 grams of tetrahydrofuran and 29.5 grams of cyclohexanone. The film was coated by a 0.5 mil bar and cured in a forced air oven for 10 minutes. The next coating was a charge generator layer containing 35 percent by weight of vanadyl phthalocyanine particles dispersed in the linear high molecular weight, high viscosity poly(hydroxy ether) of Example I in methyl cellusolve acetate, and having a thickness of 1 micrometer which was coated as follows: 0.35 gram of vanadyl phthalocyanine pigment and 0.65 gram of the poly(hydroxy ether) were roll milled for 24 hours in the above-mentioned solvent employing stainless steel shot. The film was coated utilizing a 0.5 mil bar and cured at 100° C. for 10 minutes. The transport layer was comprised of 50 weight percent N,N'-bis(3-methylphenyl)-(1,1'biphenyl)-4,4'-diamine and 50 weight percent of polycarbonate resin, available as MAKROLON ® (available from Farbenfabricken Bayer A.G.), applied as a solution in methylene chloride. The coated device was heated in a vacuum oven maintained at 80° C. to form a charge transport layer having a thickness of 30 micrometers.

The above imaging member was negatively charged to a surface potential of 800 volts, and discharged residual potential of 65 volts. The dark decay of this device was about 35 volts/second. Further, the electrical properties of the above prepared photoresponsive imaging member remained essentially unchanged for 10,000 cycles of repeated charging and discharging.

EXAMPLE V

An imaging device was fabricated by repeating the process of Example IV with the exception that BAKELITE ®, a commercially available resin, was used. The resulting dispersion was stable for only 5 days. The imaging member was charged by a corona to a surface potential of 800 volts and discharged to a residual potential of 135 volts. The dark decay of this member was 150 volts/second which is 115 volts/-second higher than the imaging member of Example IV. Higher dark decay results in undesirable lower dark development potential for the imaging member.

It is believed that images with excellent resolution with substantially no background deposits can be obtained with the imaging members of the present invention subsequent to development with known toner compositions comprised, for example, of styrene n-butyl methacrylate copolymer resin, 88 weight percent, 10 weight percent of carbon black, and 2 weight percent of the charge additive distearyl dimethyl ammonium methyl sulfate, reference U.S. Pat. No. 4,560,635, the disclosure of which is totally incorporated herein by reference.

Although the invention has been described with reference to specific preferred embodiments, it is not intended to be limited thereto, rather those skilled in the art will recognize variations and modifications may be made therein which are within the spirit of the invention and within the scope of the following claims.

What is claimed is:

1. A photoconductive imaging member consisting essentially of a photogenerating layer consisting essentially of a photogenerating pigment or pigments dispersed in a linear phenoxy resin with a weight average molecular weight of from 80,000 to 150,000, and a charge transport layer comprised of transport molecules dispersed in a resinous binder.

2. An imaging member in accordance with claim 1 wherein the charge transport layer is comprised of aryl amine hole transport molecules dispersed in a resinous binder.

3. A photoconductive imaging member in accordance with claim 2 wherein the hole transport molecules are comprised of aryl amines of the formula

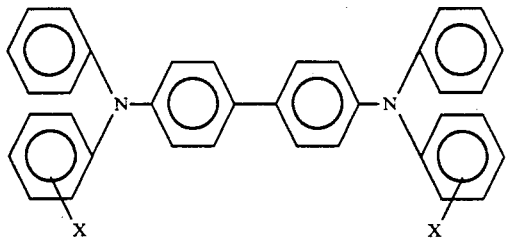

wherein X is independently selected from the group consisting of alkyl and halogen.

4. A photoconductive imaging member in accordance with claim 3 wherein the hole transport molecules are comprised of the aryl amine N,N'-diphenyl-N,N'-bis(3-methyl phenyl)-(1,1'-biphenyl)-4,4'-diamine.

5. A photoconductive imaging member in accordance with claim 3 wherein the photogenerating pigment possesses excellent dispersion characteristics in said linear phenoxy resin.

6. A photoconductive imaging member in accordance with claim 1 containing a charge blocking layer and an adhesive layer.

7. A method of imaging which comprises generating an electrostatic image on the imaging member of claim 1; subsequently transferring this image to a suitable substrate; and thereafter permanently affixing the image thereto.

8. A photoconductive imaging member consisting essentially of a supporting substrate, a photogenerating layer consisting essentially of a photogenerating pigment dispersed in a linear phenoxy resin with a weight average molecular weight of from 80,000 to 150,000, and a charge transport layer comprised of transport molecules dispersed in a resinous binder.

9. An imaging member in accordance with claim 8 wherein the phenoxy resin is poly(hydroxyether) obtained from the reaction of Bisphenol A and an epihalohydrin.

10. A photoconductive imaging member in accordance with claim 9 wherein the epihalohydrin is 1-chloro-2,3-epoxypropane.

11. A photoconductive imaging member in accordance with claim 4 wherein the phenoxy resin is comprised of 4,4'-(1-methylethyldene)bisphenol-poly(hydroxyether) with a molecular weight of 150,000 as determined by gel permeation chromatography.

12. A photoconductive imaging member in accordance with claim 9 wherein the photogenerating pigment possesses excellent dispersion characteristics in said linear phenoxy resin.

13. A photoconductive imaging member in accordance with claim 8 wherein the charge transport layer contains aryl diamine hole transport molecules in a resin binder.

14. A photoconductive imaging member in accordance with claim 8 wherein the supporting substrate is comprised of a conductive component on an organic polymeric composition.

15. A photoconductive imaging member in accordance with claim 8 wherein the photogenerating layer is comprised of inorganic or organic photoconductive pigments.

16. A photoconductive imaging member in accordance with claim 10 wherein the photogenerating layer is comprised of selenium, selenium alloys, trigonal selenium, vanadyl phthalocyanine, squaraines, perylenes, metal free phthalocyanines, metal phthalocyanines, dibromoanthanthrone pigments, or mixtures thereof.

17. A photoconductive imaging member in accordance with claim 15 wherein the photogenerating layer is situated between a supporting substrate and the charge transport layer.

18. A photoconductive imaging member in accordance with claim 15 wherein the hole transport layer is situated between the photogenerating layer and a supporting substrate.

19. A photoconductive imaging member in accordance with claim 15 wherein the resinous binder for the charge transport is a polycarbonate.

20. A photoconductive imaging member in accordance with claim 2 containing a charge blocking layer and an adhesive layer.

21. A photoconductive imaging member in accordance with claim 8 containing an organosilane charge blocking layer and an adhesive layer.

22. A method of imaging which comprises generating an electrostatic image on the imaging member of claim 8; subsequently transferring this image to a suitable substrate; and thereafter permanently affixing the image thereto.

* * * * *